US005826531A

United States Patent [19]

Havnaer, Jr.

[11] Patent Number: 5,826,531

[45] Date of Patent: Oct. 27, 1998

[54] MOORING CLEAT COVER

[75] Inventor: Richard A. Havnaer, Jr., Myrtle Beach, S.C.

[73] Assignee: Richard Alan Havner, Jr., Myrtle Beach, S.C.

[21] Appl. No.: 376,354

[22] Filed: Jan. 23, 1995

[51] Int. Cl.[6] ..... B63B 21/04

[52] U.S. Cl. ..... 114/218; D8/356

[58] Field of Search ..... 114/218; 135/73; 150/166; D8/356

[56] References Cited

U.S. PATENT DOCUMENTS

| | | | |
|---|---|---|---|
| 4,685,500 | 8/1987 | Silvia | 114/218 |
| 5,327,844 | 7/1994 | Kress | 114/218 |

*Primary Examiner*—Jesus D. Sotelo

[57] ABSTRACT

The present invention relates to a cleat cover having a dome shaped body defining an aperture for receiving a cleat therein. Leading into the cleat holding aperture is an opening which allows a rope to pass through the cleat cover to engage the cleat. An insert is attached around the opening to prevent a rope from damaging the cleat cover. The cleat cover has an extended ligature that connects the cleat cover to the cleat.

7 Claims, 2 Drawing Sheets

MOORING CLEAT COVER

BACKGROUND OF THE INVENTION

1. Field of the Invention

The present invention relates to cleats, which are used as mooring devices on docks, piers, boats, or other applicable uses.

2. Description of the Prior Art

Cleats are often used to secure a vessel to a pier or dock. A cleat is usually made out of a metallic material or other hard substance. Cleats are often located on the edges of a dock or pier and on the forward and aft corners of a boat.

Cleats often pose problems, due to its above ground structure protruding from the attached surface. They can easily be tripped over, bumped into, or fallen on causing injury to individuals. In addition, articles of clothing, life preservers, or other materials may become accidentally caught on the cleat contributing to injuries or drowning.

Many ski boats have center pylons that are used to tie a ski rope to the boat. This creates a problem when there are cleats on the back corners of the boat. The rope repeatedly becomes caught upon the cleat creating problems for the skier and driver while also causing damage to the ski rope. The rope may get caught upon the cleat, building up the tension on both the rope and cleat, and therefore increasing the likelihood of the rope breaking or releasing from the cleat. The force behind the rope can also cause the cleat to disengage from the boat's surface. These problems can result in injuries to the driver, passengers, and/or skier.

In summary, many docks, piers, and boats have cleats which protrude from a mounting surface. Traditionally the mounting surfaces are used for recreational purposes and are often surrounded by bare feet making the cleats a dangerous obstacle.

In an attempt to minimize the danger associated with cleats, cleat covers have been constructed. An example of such a cleat cover is disclosed in U.S. Pat. No. 4,685,500 to Silvia, wherein the cleat cover is constructed from a two piece covering held together around respective halves of the cleat by elastic bands. A first piece is designed to receive one half of the cleat while a second half is designed to receive the other half of the cleat. The two pieces are then held together by elastic cords that can be stretched apart and placed atop the cleat. The elastic cords then recoil and clasp around cleat. Unfortunately, the elastic bands create a new hazard to the user. When the Silvia cleat cover is removed from cleat, the bands must be pulled apart creating a greater tension on the elastic cords. If the user loses a grip on one half of the cleat cover the tension can release and cause the elastic cords to snap back with the other half of the cleat cover following. Likewise the elastic cords could break under tension causing injury to nearby individuals and rendering the cleat covers useless.

Numerous innovations for cleats and cleat covers have been provided in the prior art that are described as follows. Even though these innovations may be suitable for the specific individual purposes to which they address, they differ from the present invention as hereinafter contrasted.

SUMMARY OF THE INVENTION

Accordingly, it is an object of the present invention to alleviate the hazards associated with cleats. The following invention can be referred to as a mooring cleat cover. The mooring cleat cover is a single unit made out of rubber or other elastomeric material to give a cushioning bumper to its surroundings and to allow a snug fit atop a cleat. The cleat cover has a top surface which slopes upward to form a dome, the dome allowing for a foot to easily glide over as well as to keep other objects from getting caught upon the cleat. A bottom surface of the cleat cover forms an oval flat surface that fits flush to a mounting surface. An aperture is provided in the middle of the bottom surface to tightly fit the base and prongs of a cleat. On one side of the mooring cleat cover there is an opening in communication with the aperture, the opening dimensioned to permit a rope to be engaged to the cleat while the cleat remains covered. On an outward portion of the opening a plastic insert is provided to prevent the cleat cover from wearing away.

A ligature is attached at one end to the mooring cleat cover and at another end to the cleat. The ligature serves as a tether line and prevents the mooring cleat cover from being lost when removed from the cleat. The mooring cleat cover is configured to be placed upon the cleat with excess or slack ligature inserted into the aperture and out of the way. A rope anchoring to the cleat is able to pass through the mooring cleat cover through the opening into the aperture.

It is an object of the present invention to provide an improved cleat cover which reduces the dangers associated with an exposed cleat.

It is a further object of the present invention to provide a cleat cover which is safe and poses no hazard to an individual.

It is yet another object of the present invention to provide a mooring cleat cover which is one piece in construction and eliminates the need of elastic cords or other parts used to hold the mooring cleat cover together.

Further objects and advantages of my invention will become apparent from a consideration of the drawings and ensuing detailed description.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

1—mooring cleat cover
10—bottom surface of mooring cleat cover
12—top exterior dome surface of mooring cleat cover
14—opening into aperture
16—aperture
18—insert
20—ligature
22—cleat
22A—prongs of cleat
22B—base of cleat

BRIEF DESCRIPTION OF THE DRAWINGS

The above described and other features of the present invention will be more readily apparent when the following detailed description is considered in conjunction with the accompanying drawings, wherein.

DETAILED DESCRIPTION OF THE PREFERRED EMBODIMENT

Figure 1:
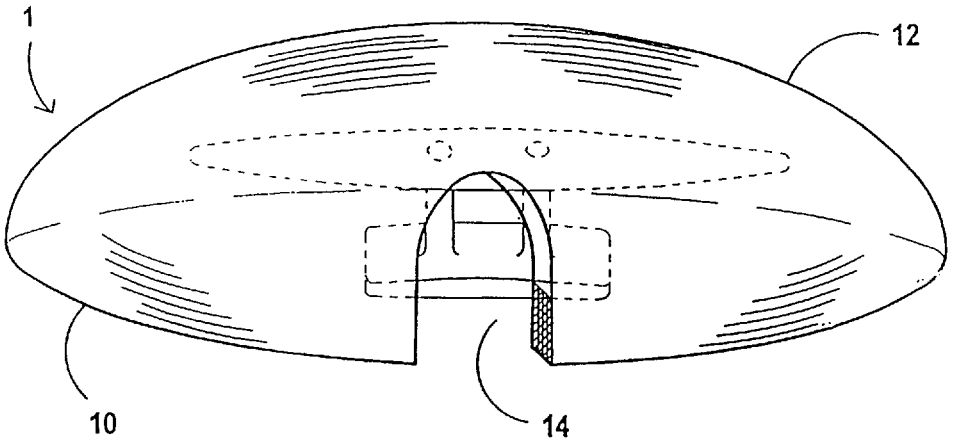
FIG. 1 is a front elevational view of a mooring cleat constructed in accordance with a preferred embodiment of the present invention.
Figure 2:
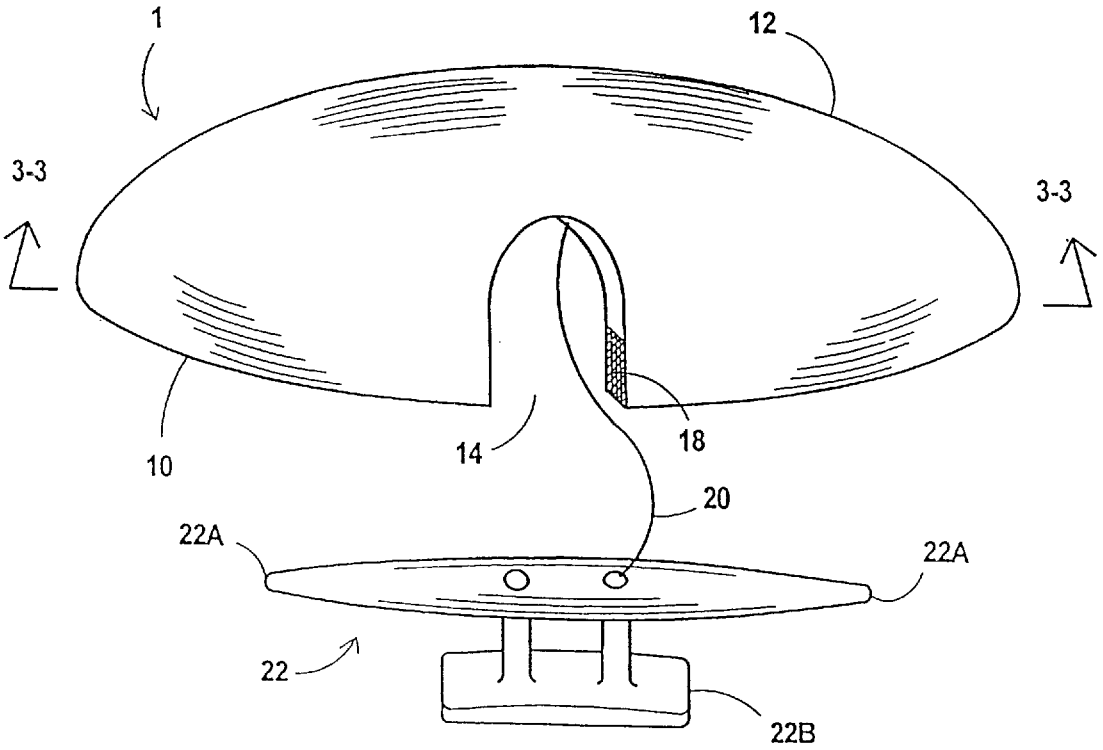
FIG. 2 is view similar to that of FIG. 1 illustrating the cleat cover in proximity to a cleat.

Referring initially to FIGS. 1–2, mooring cleat cover 1 is constructed of rubber, although other elastomeric materials are contemplated, to provide a smooth and cushioned barrier between cleat 22 and its surroundings. The cover 1 generally has an oval dome shaped structure such that objects which contact the cover to glide over the surface with ease.

Figure 3:
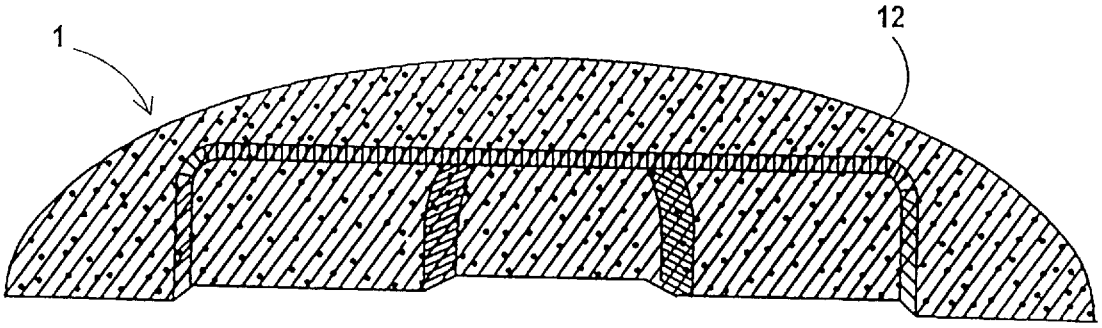
FIG. 3 is cross-sectional view of the of the mooring cleat cover of FIG. 2 taken along lines 3—3 illustrating the interior of the cleat cover.
Figure 4:
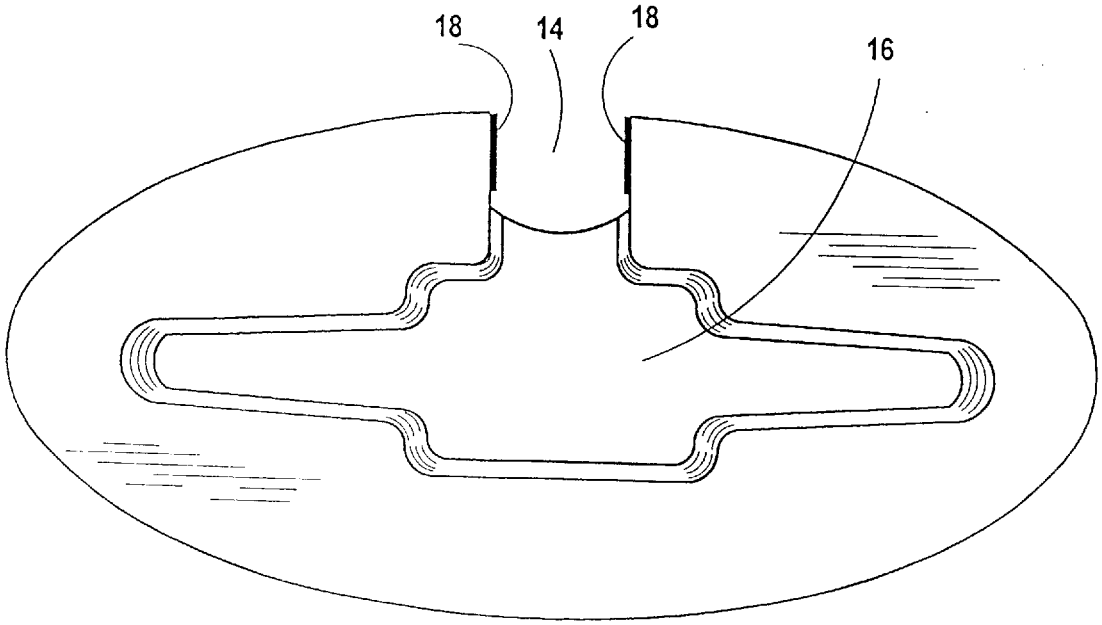
FIG. 4 is a bottom view of the cleat cover of FIG. 1 illustrating an aperture for receiving a cleat.

Referring to FIG. 4 in conjunction with FIG. 2, the cover 1 has a bottom surface 10 which is substantially flat to lay against the surface to which the cleat 22 is mounted. The bottom surface 10 defies an aperture 16 dimensioned to receive cleat 22 therethrough. The aperture 16 has a shape generally corresponding to that of cleat 22 to accommodate the prongs 22A and base 22B of the cleat 22. As best seen in FIG. 3, the cleat 1 defines an internal space dimensioned to receive a majority of the cleat 22 therein such that the cover 1 fits snugly atop the cleat 1. On one side of the cover 1 there is an opening 14 that leads into the aperture 16. The opening 14 is dimensioned to permit insertion of a rope therethrough.

Referring to FIG. 4, a plastic insert 18 is mounted to an internal wall of the cleat cover adjacent the opening 14. The insert 18 is adapted to contact a rope passing into the aperture 16. The insert 18 is positioned adjacent the opening 14 to prevent the rope from rubbing away the elastomeric material of the cover 1.

In use, the cover 1 can be easily removed for anchoring ropes to the cleat 22. To prevent the cover 1 from being knocked into the water, a ligature 20 is attached at one to an internal portion of the cover (not shown). As shown in FIG. 2, the other end of the ligature 20 is attached to the cleat 22 by one of the cleat mounting bolts. The ligature 20 remains connected to the cleat 22 while the cover 1 is atop of the cleat 22 while the left over slack from the ligature 20 is placed in the aperture 16. Therefore the left over slack from the ligature 20 is out of the way and cannot be tripped upon or miscellaneous materials cannot become caught upon the ligature 20.

In order to anchor a rope to the cleat 22, the cover 1 is easily disengaged from the cleat 22 by pulling it off. A rope can then be applied to the cleat 22. After the rope is anchored securely to the cleat 22, the cover 1 can be placed back atop the cleat 22. The cleat 22 fits securely into the aperture 16 inside the cover 1. The rope anchoring to the cleat 22 passes through the opening 14 and extends to the outside of the cover 1.

The description above contains many different examples and should not be construed as limiting the scope of the invention but merely as providing illustrations of some of the presently preferred embodiments of this invention.

Thus the scope of this invention should be determined by the appended claims.

It will be understood that each of the elements described above, or two or more together, may also find a useful application in other types of constructions differing from the type described above.

While the invention has been illustrated and described as embodied in a cleat cover, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A cleat cover removably attached to a cleat, comprising:

a) a unitary body having a side portion, the body further having an internal wall defining an aperture dimensioned to receive a cleat therein, the side portion defining an opening in communication with the aperture, the opening dimensioned to receive a portion of a rope therethrough;

b) a ligature having a first end and a second end, the first end attached to the internal wall of the body, the second end adapted to be attached to the cleat; and c) a rope contacting member attached to the body adjacent the opening, the rope contacting member adapted to contact the rope to prevent wear of the body.

2. The cleat cover of claim 1 wherein the body is made of an elastomeric material.

3. The cleat cover of claim 1 wherein the rope contacting member is made of plastic.

4. The cleat cover of claim 2 wherein the elastomeric material is rubber.

5. A cleat cover removably attached to a cleat, comprising:

a) a unitary dome shaped body having a side portion, the body further having an internal wall defining an aperture dimensioned to receive a cleat therein, the side portion defining an opening in communication with the aperture, the opening dimensioned to receive a portion of a rope therethrough;

b) linking means for securing the cover to the cleat, the linking means having a first end and a second end, the first end attached to the internal wall of the body, the second end adapted to be attached to the cleat; and c) a plastic insert attached to the body adjacent the opening, the insert adapted to contact the rope so as prevent wear of the body through contact with the rope.

6. The cleat cover of claim 5 wherein the cover is made of an elastomeric material.

7. A cleat cover removably attached to a cleat, comprising:

a) a body having a side portion, the body further having an internal wall defining an aperture dimensioned to receive a cleat therein, the side portion defining an opening in communication with the aperture, the opening dimensioned to receive a portion of a rope therethrough;

b) linking means for securing the cleat cover to the cleat, the linking means having a first end and a second end, the first end attached to the internal wall of the body, the second end adapted to be attached to the cleat; and c) a rope contacting member attached to the body adjacent the opening, the rope contacting member adapted to contact the rope to prevent wear of the body.

* * * * *